US007578719B1

(12) United States Patent
Faanes et al.

(10) Patent No.: US 7,578,719 B1
(45) Date of Patent: Aug. 25, 2009

(54) SCULPTURE METHOD UTILIZING NEW MEANS OF SIMULATING, VIEWING, AND DISPLAYING SPORTING, UNDERSEA AND OTHER ENVIRONMENTS

(75) Inventors: Perry C. Faanes, 34247 Via Santa Rosa, Capistrano Beach, CA (US) 92624; Phil Dean Roberts, Corona Del Mar, CA (US)

(73) Assignee: Perry C. Faanes, Capistrano Beach, CA (US)

( * ) Notice: Subject to any disclaimer, the term of this patent is extended or adjusted under 35 U.S.C. 154(b) by 148 days.

(21) Appl. No.: 11/424,422

(22) Filed: Jun. 15, 2006

Related U.S. Application Data

(63) Continuation-in-part of application No. 10/781,587, filed on Feb. 17, 2004, now abandoned.

(60) Provisional application No. 60/450,342, filed on Feb. 28, 2003.

(51) Int. Cl.
*A63H 33/22* (2006.01)
*A63H 33/00* (2006.01)

(52) U.S. Cl. ..... 446/219; 446/129; 446/139; 472/61

(58) Field of Classification Search ..... 472/61, 472/63; 40/427, 453; 446/129, 139, 92, 446/219
See application file for complete search history.

(56) References Cited

U.S. PATENT DOCUMENTS 2,484,116 A * 10/1949 Papke ..... 472/57
3,244,468 A * 4/1966 Meltzer ..... 351/239
4,120,116 A * 10/1978 Williams ..... 446/219
4,192,580 A * 3/1980 Meyer ..... 359/801
5,013,278 A 5/1991 Dixon et al.
5,407,391 A * 4/1995 Monroe et al. ..... 472/61
5,542,870 A 8/1996 Westersund
5,707,237 A 1/1998 Takemoto et al.
5,848,029 A 12/1998 Chang
6,131,318 A 10/2000 Hsieh
2004/0169312 A1 9/2004 Roberts et al.
2007/0197126 A1 8/2007 Derrah

* cited by examiner

*Primary Examiner*—Kien T Nguyen
(74) *Attorney, Agent, or Firm*—NovaTech IP Law

(57) ABSTRACT

This invention is directed toward a sculpture, and the method of making the sculpture, utilizing a mold and manufacturing method in which the underside of the mold mimics the top of an ocean bottom, or other underwater environment, which can be painted to realistically depict different types of corals and fishes. This ocean bottom can be seen through clear, smooth-surfaced sections of the front, sides, and back of the sculpture, thereby creating an "aquarium view" of the ocean bottom. The invention also contains a fish-eye lens, which can be moved in several directions, thereby affording a user numerous views of the surfer, wave, and ocean bottom from different perspectives, or of other aquatic sportspeople engaging in various aquatic sports. The fish-eye lens can be mounted above the water, or at the waterline, thereby affording a view of the environment and actions both above and below the waterline.

9 Claims, 7 Drawing Sheets

SCULPTURE METHOD UTILIZING NEW MEANS OF SIMULATING, VIEWING, AND DISPLAYING SPORTING, UNDERSEA AND OTHER ENVIRONMENTS

CROSS REFERENCE TO RELATED APPLICATIONS

This is a continuation-in-part application of application Ser. No. 10/781,587, entitled SCULPTURE METHOD UTILIZING NEW MEANS OF SIMULATING, VIEWING, AND DISPLAYING SPORTING, UNDERSEA AND OTHER ENVIRONMENTS, filed Feb. 17, 2004 that claims priority of Provisional Application entitled SCULPTURE METHOD UTILIZING NEW MEANS OF SIMULATING, VIEWING, AND DISPLAYING SPORTING, UNDERSEA AND OTHER ENVIRONMENTS, filed Feb. 28, 2003 and given USPTO No. 60/450,342.

STATEMENT REGARDING FEDERAL SPONSORSHIP OF RESEARCH

This invention was not federally sponsored.

BACKGROUND OF THE INVENTION

This invention is directed toward a sculpture, and the method of making the sculpture, utilizing a mold and manufacturing method in which the underside of the mold mimics the top of an ocean bottom, or other underwater environment, which can be painted to realistically depict different types of corals and fishes.

This ocean bottom can be seen through clear, smooth-surfaced sections of the front, sides, and back of the sculpture, thereby creating an "aquarium view" of the ocean bottom. The invention also contains a fish-eye lens, which can be moved in several directions, thereby affording a user numerous views of the surfer, wave, and ocean bottom from different perspectives, or of other aquatic sportspeople engaging in various aquatic sports. The fish-eye lens can be mounted above the water, or at the waterline, thereby affording a view of environments and actions both above and below the waterline.

Sculpture has been a popular art form since around 30,000 B.C., which is the approximate date that the earliest sculptures found were created. While the early Germanic peoples who created these sculptures have been credited as the earliest "sculptors", there is another line of reasoning which holds that sculpture is an art form that should really go back to the earliest wooden clubs. In any case, sculpture has been an accepted form of re-creating objects and making artistic statements for much of human history.

Over the years, sculpture has evolved from basic wooden carvings and clay molding to active manipulation of a variety of media. Three dimensional sculpture aimed toward faithfully re-creating a scene has become one of the more popular forms of sculpture, with a number of recreations, whether miniature or full size, of famous landmarks and scenes from human experience providing entertainment and profit to locations ranging from prestigious art galleries and museums to tacky gift shops and souvenir stands.

Re-creating ocean and other water environments has been a goal of many artists who enjoy aquatic sports and the unique environment of the locales in which aquatic sports take place. There have been numerous attempts to portray three-dimensional aquatic environments as a way to allow people to "experience" what is otherwise a fairly hostile environment.

Many of these attempts have aimed toward allowing a land-based human to see what an aquatic environment really looks like—the most common example of this is the common aquarium, which allows a viewer to see how fish and other aquatic animals swim, eat, and reproduce. To date, however, there has not been invented a device which accurately depicts the sport of surfing, and other aquatic sports, so that a non-surfer can visualize how the various components of surfing—the surfer, the surfboard, the wave, and the ocean bottom—all interrelate to result in the exhilaration of a surfing ride. The present invention addresses this need.

The invention has a number of possible iterations, but we shall use the sport of surfing as an example to illustrate the various aspects of the invention, as it is the best mode of this invention.

It would be useful to describe some basic terminology relating to ocean waves and surfing in general so that a reader has adequate knowledge to appreciate and practice the invention. The vast majority of the waves used by surfers for surfing are created by wind blowing over the ocean's surface. The size of the wave depends upon the velocity of the wind, the amount of time the wind blows, and the fetch, or the size of the area over which the wind blows. As the waves move toward a shallow ocean bottom (usually found near the coastline, with some notable exceptions such as the Cortes Bank, which is a submerged reef over a hundred miles off the California coast), the waves become more steep. When the water is approximately one and one half times deeper than the wave is tall, the wave begins to break. If the ocean bottom gradually becomes shallower—such as occurs with some of the gently sloping sandbars off the California coastline—the wave will gently spill over, creating a weakly breaking wave which is ideal for beginners. In areas where the ocean bottom rises more abruptly—such as the coral reefs of Hawaii and other tropical locations—the waves break with much more force, and the top of the wave races over the bottom of the wave, resulting in a "top to bottom" break which frequently pitches out so far and so quickly that it creates a hollow cylinder of air inside the wave, which is called the tube.

No matter how the wave breaks, all waves have a front face, which is the part of the wave which faces the beach, and a back face, which faces out to sea. A person standing on the beach will always see the front face; a boat out beyond the breakers will always see the back face. A surfer (or surf photographer) to the side of a breaking wave can get a view sideways down the wave "down the line", such that he/she can see a surfer inside of the tube. This is considered one of the optimum views of a surfer in action. Another very popular view of the surfer is an underwater view, taken usually by a surf photographer who has positioned himself/herself such that the wave rolls over his/her head with a surfer only a few feet away, allowing a shot from underwater which shows the silhouette or shadow of the surfer against the texture of the front face of the wave.

The object of surfing is to position the surfboard either in the tube or directly in front of the breaking portion of the wave, an area known as the "pocket" of the wave, which contains the most energy and allows for the most explosive and radical maneuvers. A skilled surfer performs a variety of maneuvers designed to keep the surfboard around the pocket, including stalls, cutbacks, 360's, rollercoasters, and bottom turns. It is the profession of the surf photographer to capture these maneuvers and record them for the enjoyment of the general public in the form of magazine pictures and surf movies. While there have been attempts to capture the beauty, thrills, and inherent danger in the sport of surfing in three-dimensional form, prior to this invention such attempts have failed to adequately portray the surfing environment as a whole. The present invention meets this long-felt need by faithfully replicating the surfing environment—including the wave form, the act of surfing the wave, and the underwater environment beneath the wave—in a means which is both eye-pleasing and readily lends itself to mass production via molds. The invention has a number of components which will be discussed below.

A major part of the invention is the use of a clear, transparent backsides and sides to the wave, and a clear front portion of the wave, such that a person can view the back, sides, and front of the sculpture and see through the wave. This provides two unique and attractive views which prior to this invention were not utilized. First, a viewer can see the texture of the wave face on the front of the wave. As illustrated by the figure, the wave face of these sculptures is textured in a manner such that it appears similar to the wind-whipped face of an actual ocean wave. The transparent resin or plastic from which the sculpture is created allows a viewer to see a vague silhouette or shadow of the surfer through the textured face of the wave. This type of view was popularized in the surf movie Free Ride, which was one of the pivotal surf films of the late 1970's. Free Ride was the first surf movie to make extensive use of the underwater perspective in shooting surfers as then traversed the wave faces. The present invention represents the first attempt to capture this perspective in a sculpture of the sport of surfing.

The second unique view the clear wave back provides is in allowing a viewer to see an artist's rendition of the ocean bottom and its flora and fauna at a particular geographic location. Due to the differences in water temperature at different latitudes, ocean currents, sedimentary deposition sources such as rivers, and other variables, the ocean bottom upon which waves break, along with the associated fish, invertebrates, and marine algae and plants varies dramatically throughout the world. The present invention captures these different ocean bottoms, ranging from the jagged coral reefs and colorful fishes of Hawaii to the sand bottoms, eelgrass, bat rays and sharks found in many California surf spots. The equipment used by the surfer will also vary with the wave conditions. For example, the surfer on the small wave in Southern California surfs a "cruiser" long board and wears surf trunks, the Hawaiian surfer needs a tri-fin thruster and strong surf leash to handle the powerful reef surf found in the Islands, while the Northern California surfer wears a wetsuit, booties, and a hood for protection against the cold waters.

In another aspect of the invention at least one figure configured as an actor in the scene is movably positioned on the base. The figure is maintained in position on the surface of the base member by magnetic attraction between magnetic or magnetically attracted material on the lower surface of the support base of the figure and a magnetic control element on the exterior surface of the base member.

Another major part of this invention is the method by which the ocean bottoms are created. Artists such a Wyland and Lassen have captured the beauty of the different underwater scenes in their two-dimensional paintings and murals, but prior to this invention there has not been a sculpture which recreates a three-dimensional view of the underwater environment. The method of recreating the underwater scene is an essential part of this invention as it utilizes a potentially far-ranging process which lends itself readily to mass production, and is not limited to merely faithfully re-creating ocean bottoms. Rather, this method has clear applicability to rivers, swimming pools, diving pools, undersea SCUBA diving environments, and even miniatures of famous waterfronts throughout the world.

To recreate an ocean bottom, the invention relies upon an artist to make a clay mold of an ocean bottom environment using traditional potter's tools along with dremels and other motorized devices. Each item in the ocean bottom, including the substrate, corals, fish, algae, plants, and other unique characteristics of each sculpture's environment are individually handcrafted into the clay mold, along with the shapes of the wave and surfer. The clay mold, when finished, is then used as the sample from which a metal mold is created.

After the metal mold is formed, mass production of the sculpture is commenced. After each sculpture is finished, a painter applies a variety of paints to the underside of the sculpture so that each indentation is painted in realistic colors and tones to mimic its real life counterpart. The finished result is such that a viewer sees the ocean bottom and its associated flora and fauna from an "aquarium view", which realistically depicts a number of different ocean/surf environments in a manner which allows a viewer to feel that he/she is a part of the environment.

The invention as it relates to the sport of surfing has two basic iterations, both of which are readily adaptable to the further sports, hobbies, and landmarks discussed later in this patent. First, the sculpture can be designed for viewing solely as a three-dimensional sculpture, with attractive views offered on all four sides. From the direct front of the sculpture, the viewer will see a normal view that a beachgoer would see as he/she looked out into the waves. The two end views would simulate a "surfer's view" which would be seen by another surfer paddling out through the waves looking "down the line" into a wave being surfed by another surfer. The back view would be the aforementioned "aquarium view" through the back of the wave which encompasses both the textured face of the wave and the surfer silhouette on the other side of the textured face, and the locale-specific ocean bottom.

A second iteration of the surfing sculpture involves the use of a "fish-eye" viewer which is enclosed in a circular cavity molded into the sculpture. The viewer allows a user of the invention to view the surfer from inside the "tube", which is a cylindrically hollow wave caused by the wave breaking over a rapidly rising ocean bottom, whereupon the top portion of the wave "pitches out" and creates a hollow cylinder through which a skilled surfer can ride his/her surfboard. The eyepiece can be either fixed or moveable. With the fixed eyepiece, the only view a user has is of the wave tubing over the head of the surfer. With the moveable eyepiece, a user can view the surfer from different angles, as well as directing the eyepiece down toward the ocean bottom, allowing for an attractive view of the sand, coral, sponges, algae, seaweeds and fishes found on ocean bottom ("algae" are aquatic plants such as kelp which reproduce without the seeds found in real plants, sexually reproducing marine plants are generally called "seaweeds").

The "fish-eye" viewer has further applications to "split-level" views of the air/water interface. Since many water sports take place at least partially on the surface of the water, the invention can be used to simulate the view an ocean sport enthusiast will get when he/she is looking above and below the waterline. For sports such as surfing, snorkeling, fishing, and kayaking, the surface of the ocean or river bottom over which the sport or hobby takes place is as important as what is happening on the surface of the water, both in terms of the beauty of the underwater environment and because the wave action is directly tied to the bottom configuration of the ocean or river bottom over which the action is taking place.

The invention also lends itself to a number of additional sports and hobbies—the sport of surfing was used here merely as an example. Among the other water sports which are captured in three-dimensional form by this invention are SCUBA diving, kayaking (river kayaking, sea kayaking, and surf kayaking), river rafting, boogie boarding, fishing (lake, stream, and saltwater), body surfing, snorkeling, boating, and water skiing. In all these sports there is either a unique underwater view found in the sport which can be successfully recreated using the methods and techniques of this invention or/and there is some element of speed or other movement which lends itself to simulation through the use of an eyepiece viewer. Non-water sports related applications include car racing, track and field events, skydiving, team sports such as football, baseball, basketball and hockey, and outdoor sports such as skiing, snowboarding, rock/mountain climbing, and hiking.

The invention can also be used as a method of replicating means of transportation and famous landmarks, including those found in the water (such as oil derricks, submarines, deep sea submersibles), those found on the air/water interface (Golden Gate Bridge, famous ocean-, river-, or lakefront towns such as New York, Chicago, Los Angeles, Hong Kong and Honolulu, and waterfront landmarks such as the Hotel Del Coronado, and those found on land such as famous ski resorts like Vail and Aspen.

A further use of the invention is to recreate scenes involving animals and plants, particular those found in water and on the air/water interface. Scenes such as bears trying to catch salmon, whales coming up for air, a shark chasing a large tuna, and pelicans swooping down to catch fish all lend themselves readily to being illustrated in attractive three-dimensional representation by this invention.

There are numerous examples in the prior art of sculpture methods. For example, U.S. Pat. No. 6,383,429 by Noto teaches a method of making a sculpture which, like the present invention, suggests the use of resin to make the molded object, but Noto's method calls for embedding one such resin object within another. It does not discuss the idea of molding an undersea or other environment into the back of the resin object, nor allowing for the undersea environment to be painted to resemble coral or other underwater environments, nor does it allow for an eyeglass viewer to allow a user to "zoom in" and "zoom out" to take different views of the object.

Further objects and features of this invention will be apparent to one skilled in the art. It will be readily apparent to those skilled in the art that still further changes and modifications in the actual concepts described herein can readily be made without departing from the spirit and scope of the invention as defined by the description of this invention. It is particularly stressed that this invention is readily applicable to a number of different sports, as well as famous landmarks—both natural and human-made, and that the surf sculpture example illustrated here is not in any way meant to limit the scope of this patent.

BRIEF SUMMARY OF INVENTION

This invention is directed toward a sculpture, and the method of making the sculpture, utilizing several unique methods of simulating, viewing, and displaying sporting, undersea and other environments. It is an object of this invention that a sculpture can be created by making a mold such that the underside of the mold mimics the top of an ocean bottom, or other aquatic bottom;

It is a further object of this invention that the "ocean bottom" can be painted in different colors which realistically depict different types of corals, fishes and other undersea plants, algae, and animals found in the particular environment the artist is trying to recreate.

It is a further object of this invention that the "ocean bottom" can be seen through clear, smooth-surfaced sections of the front, sides, and back of the sculpture, thereby creating an "aquarium view" of the ocean bottom.

It is a further object of this invention that a user can view the surfer or other aquatic sportsperson through the back of the wave and see a silhouette or shadow view of the surfer as he/she traverses the wave.

It is a further object of this invention that the user be able to get a view from inside the "tube" of the wave of a rider who is surfing out of the tube away from the viewer through the use of a "fish-eye" lens.

It is a further object of this invention that, through manipulating the "fish-eye" lens, the viewer can zoom in, zoom out, and maneuver the lens to change his/her perspective on the surfer, the wave, and the ocean bottom.

It is a further object of this invention that the "fish-eye" lens can be located at the water level, thereby affording a viewer views of both above and below the waterline.

It is a further object of this invention to provide a sculpture in which at least one figure depicted in the sculpture is movable.

DETAILED DESCRIPTION OF THE INVENTION

The present invention relates to a miniature diorama scene that includes a viewing device which allows an observer to view the diorama as though he were present in the scene and further permits the observer to move a figure in the scene even while he is observing. The figures are sculpted to be consistent with the scene. Thus for a surfing scene, the figure is sculpted as an individual riding a surfboard or in the case of a skiing scene, as a skier. The diorama may contain a single FIGURE or multiple figures such as would be the case for a scene representing a baseball stadium or football stadium that may include some or all of the players that involved in the game.

More particularly the invention comprises a base member having at least an upper surface which is configured to represent the particular scene for the diorama. The base is adapted for receiving an optical viewer that includes a wide-angle lens that permits an observer to view the scene as though he were actually in it. At least one figure configured as an actor in the scene is movably positioned on the base. The figure is maintained in position on the surface of the base member by magnetic attraction between magnetic or magnetically attracted material on the lower surface of the support base of the figure and a magnetic control element on the exterior surface of the base member. Movement of the control element along the exterior surface of the base member produces movement of the figure due to magnetic attraction between the support member of the figure and the control element. It will be understood that a similar result is achieved when the support base of the figure includes magnetic material and the control element includes magnetically attracted material. The invention also contains a fish-eye lens, which can be moved in several directions, thereby affording a user numerous views of the surfer, wave, and ocean bottom from different perspectives.

Figure 1:
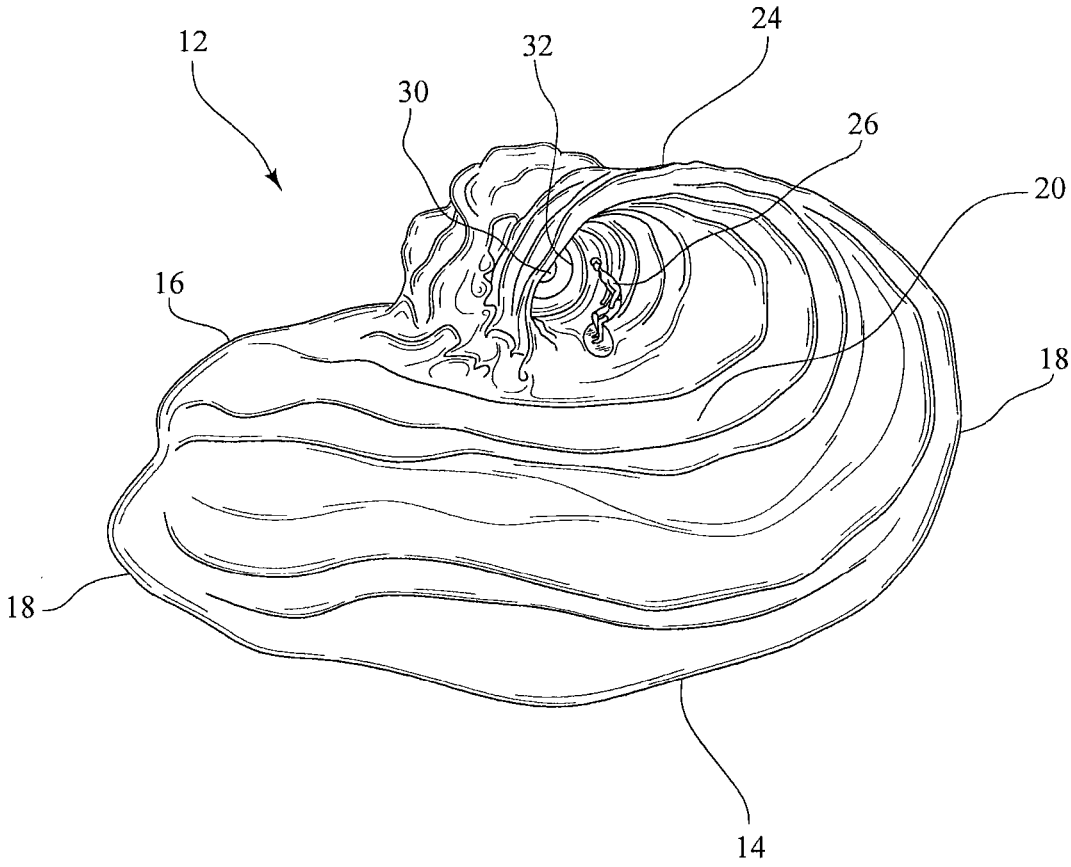
FIG. 1 is an end view of an embodiment of the present invention representing a curling wave scene and surfer as viewed from the front end of the base.

Referring to FIG. 1, the invention is depicted as a surfing setting comprising a base 12 having front, rear, and side faces 14, 16 and 18 respectively and an upper surface 20 and a bottom surface 22. As illustrated the upper surface 20 and one side face 18 are sculpted as a wave having a portion 24 of the side face 18 adjacent the rear face 16 extended above the upper surface 20 and folded over the upper surface 20 to form a cylinder, the bore of which extends from the rear face 18 and opens to the upper surface 20. Portion 24 is configured to represent the curling area of a wave as will be found with larger incoming waves that are highly desired by surfers.

The base 12 is preferably formed by casting a resin material into the desired configuration. For example, the resin may be a castable thermoplastic, epoxy, polyester isophthalic-polyester resin or the like and may be transparent, translucent or opaque. A dye may be incorporated in the resin to impart a desired color to the base 12 to improve the appearance of the scene. For example the base 12 in this illustration is typically blue or green to represent water while the curled portion may include strips of white opaque resin to represent the foam on the upper portion of a curling wave. For other types of scenes, such as for example a downhill skiing scene, an opaque white base 12 is preferred.

Casting temperature and curing conditions are dependent upon the amount of catalyst, the type of resin, the thickness of the casting, the temperature of resin and of the casting room, and the amount of dye compounded in the resin. These factors are well understood in the art.

As illustrated, a FIG. 26, generally scaled to size to fit the scene, represents a surfer riding the wave. That FIG. 26, shown in more detail in FIG. 4, includes the form of an individual and a surfboard. The lower surface of the surfboard serves as a support for the FIG. 26 and further includes a strip 38 of magnetic or magnetically attractable material for retaining the FIG. 26 on the upper surface 20 of the base 12 by a magnetic field created by a control element 27 which comprises a pair of magnets 28 located on an exterior surface of the base 12 opposite the lower surface of the surfboard.

Figure 3:
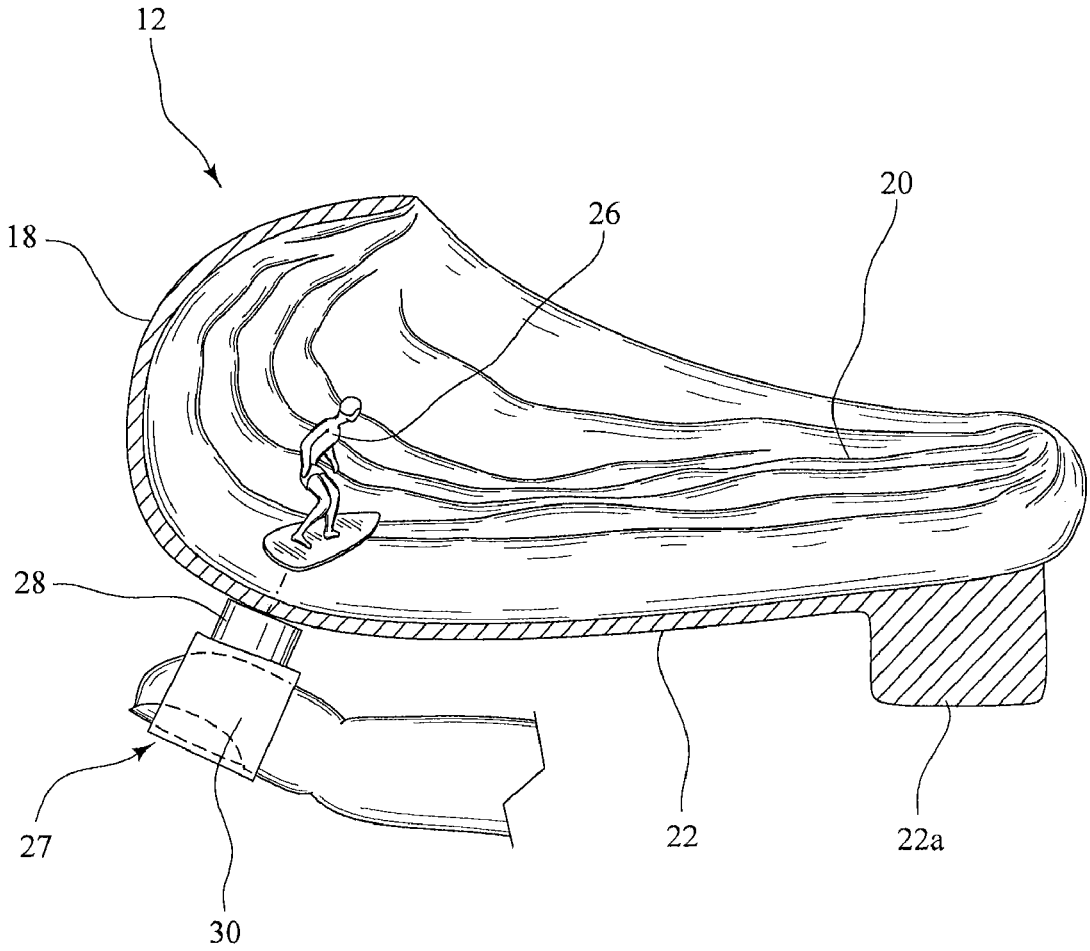
FIG. 3 is a sectional view of the embodiment of the invention shown in FIG. 1 illustrating one way of moving the figure.

As shown in FIG. 3, the magnets 28 of the control element 27 are adapted for being moved by the user's finger. As the magnets 28 are moved in a sliding fashion over the exterior surface of the base 12 the FIG. 26, by virtue of the magnetic field between the magnet 28 and the strip 38 of material on the lower surface of the surfboard, simultaneously moves to a position corresponding to the position of the magnets. In this manner the user can use the control element 27 to move the FIG. 26 to desired positions in the curl of the wave or on the upper surface 20 of the base to change the view. The outer faces of the magnets 28 opposite the side in contact with the base 12 are adapted to be moved by the user's finger, such as having an indented portion on the outer face of the magnets for the tip of a finger or, as illustrated, by securing an annular member 30 on the outer face of the magnets for receiving the end of the user's finger. The strength of the magnet will be determined primarily by the thickness of the resin between the magnet 28 on the external surface of the base 12 and the magnetic or magnetically attractable strip 38 of the FIG. 26. The magnetic field must be strong enough for the magnetic field to penetrate the base 12 to allow movement of the FIG. 26 in response due movement of the magnet 28 along the external surface of the base. It will be understood, however, that the support of the FIG. 26 may itself comprise the magnet and the control element on the exterior of the base member 12 may be a magnetically attractable material.

Although a single magnet 28 may be used in forming the control element 27 for moving the FIG. 26, the most realistic movement of the FIG. 26 is achieved when the control element comprises two magnets. It has been found that by the use of two magnets 28 the surfboard will track in a realistic manner as it moves over the upper surface of the base. With two magnets 28 the direction the FIG. 26 faces is easily controlled to produce a more realistic movement over the upper surface 20 of the base 12. With a single magnet 28, however, the FIG. 26 can be easily moved but it has a tendency to spin and it is difficult to control the direction that the FIG. 26 faces making the way it moves unrealistic.

Figure 6:
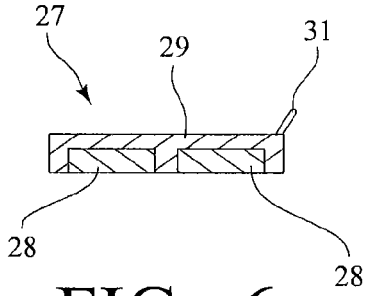
FIG. 6 is a sectional view of a different embodiment in which the magnets are retained in a body.
Figure 4:
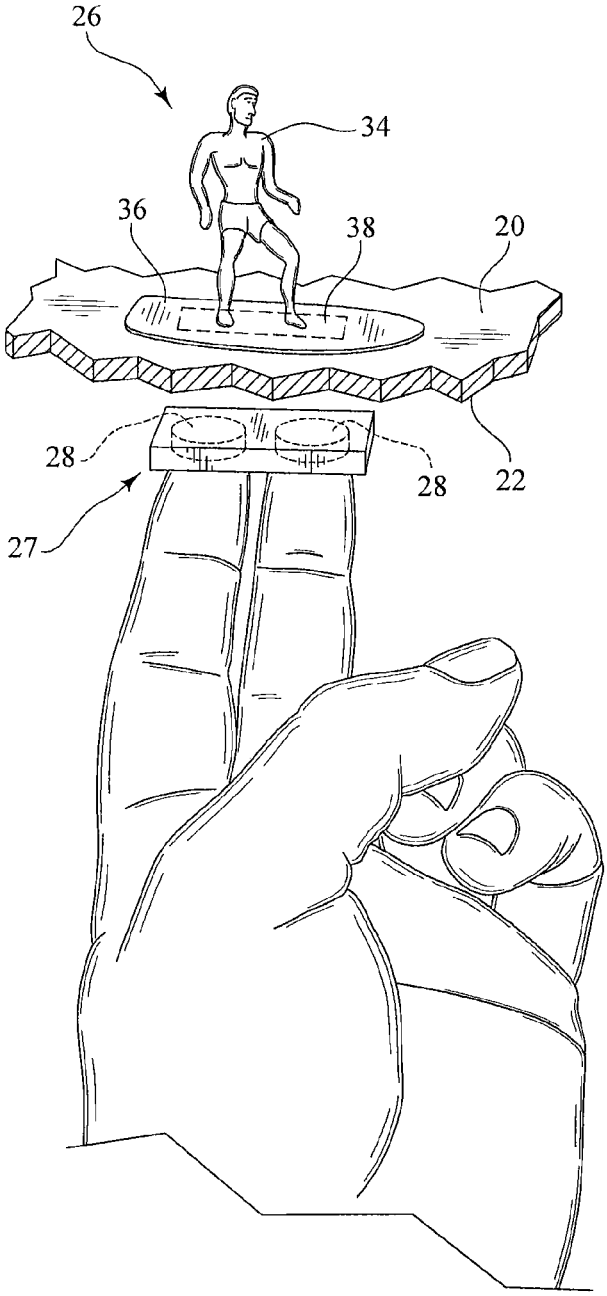
FIG. 4 is a view of the embodiment of FIG. 1, broken away for compactness of illustration, showing a method for moving the figure employing magnets at the exterior of the base member.

In FIGS. 3 and 4 the control element 27 is shown as comprising a pair of individual magnets which are adapted to be moved by the operator's fingers. In some cases it may be preferred that the control element 27 be formed as an interval unit. Referring to FIG. 6 where like reference numbers denote like elements and functions, the control element 27 comprises an integral body 29 in which are supported a pair of the magnets 28. Good results are achieved when the magnets are cast in a suitable resin, such as the resin composition used to form the base 12. For convenience a handle 31 is provided for grasping the control element 27.

To aid in the enjoyment of the miniature scene, an optical viewing device 32 is received in the bore of the cylinder formed by curling portion of the wave. The optical viewing device 32 comprises a generally cylindrical body (not shown) that includes a wide angle or "fish eye" lens (not shown). These devices are normally utilized to provide a wide-angle view outside of the closed door. Such devices are distributed for example by Direct Door Hardware, Logan, Utah or Quality Plans and Software, Iron Station, N.C.

Figure 2:
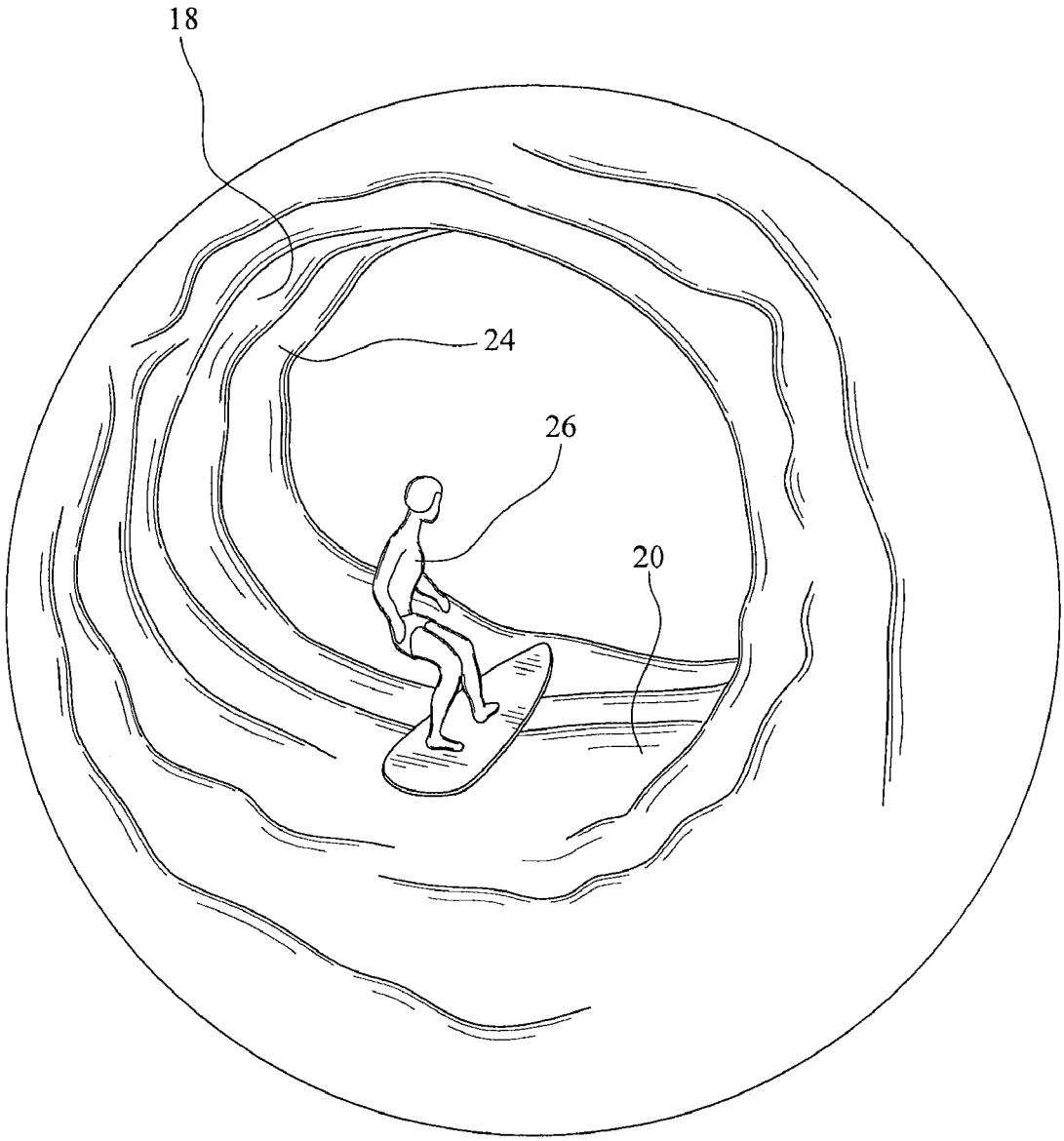
FIG. 2 is a view of the same molded resin sculpture as in FIG. 1, from the "tube" end of the sculpture, showing the view through the fish-eye lens of the surfer and the wave.

FIG. 2 illustrates the view of the scene of FIG. 1 as seen through the viewing device 32. The wide-angle lens allows the observer to view a part of the wave and the FIG. 26 slightly magnified. The view simulates what would be seen if the observer were inside the curl of the wave. As illustrated in FIG. 3 and FIG. 4, the observer, by sliding the magnets on the outer surface of the base 12, is able to move the FIG. 26 while observing it through the viewing device 32.

As most clearly shown in FIG. 4, the movable FIG. 26 comprises an actor form 34 configured to be consistent with the scene. The actor form 34 is secured to a support member 36 that supports the actor form 34 in an upright position on the upper surface 20 of the base 12. A strip 38 of magnetic or magnetically attractable material is secured to the lower surface of the support member 36 and a pair of external magnets 28 are used to move the FIG. 26 by magnetic attraction between the external magnets and the strip 38 of magnetic or magnetically attractable material as already described in connection with the embodiment of the invention shown in FIG. 1. Preferably, as already explained, the magnets 28 are moved by the observer's fingers. Alternatively, the movable FIG. 26, especially in the case of a baseball field or football field scene in which the upper surface 20 of the base 12 is essentially level, can be manually placed without the use of magnets.

It will be understood that the scenes presented by the base 12 are not limited to surfing scenes. Thus the base 12 may be configured to illustrate a downhill skiing trail where the FIG. 26 is configured as a skier or as a skateboard park with the FIG. 26 configured as a skate boarder.

Figure 5:
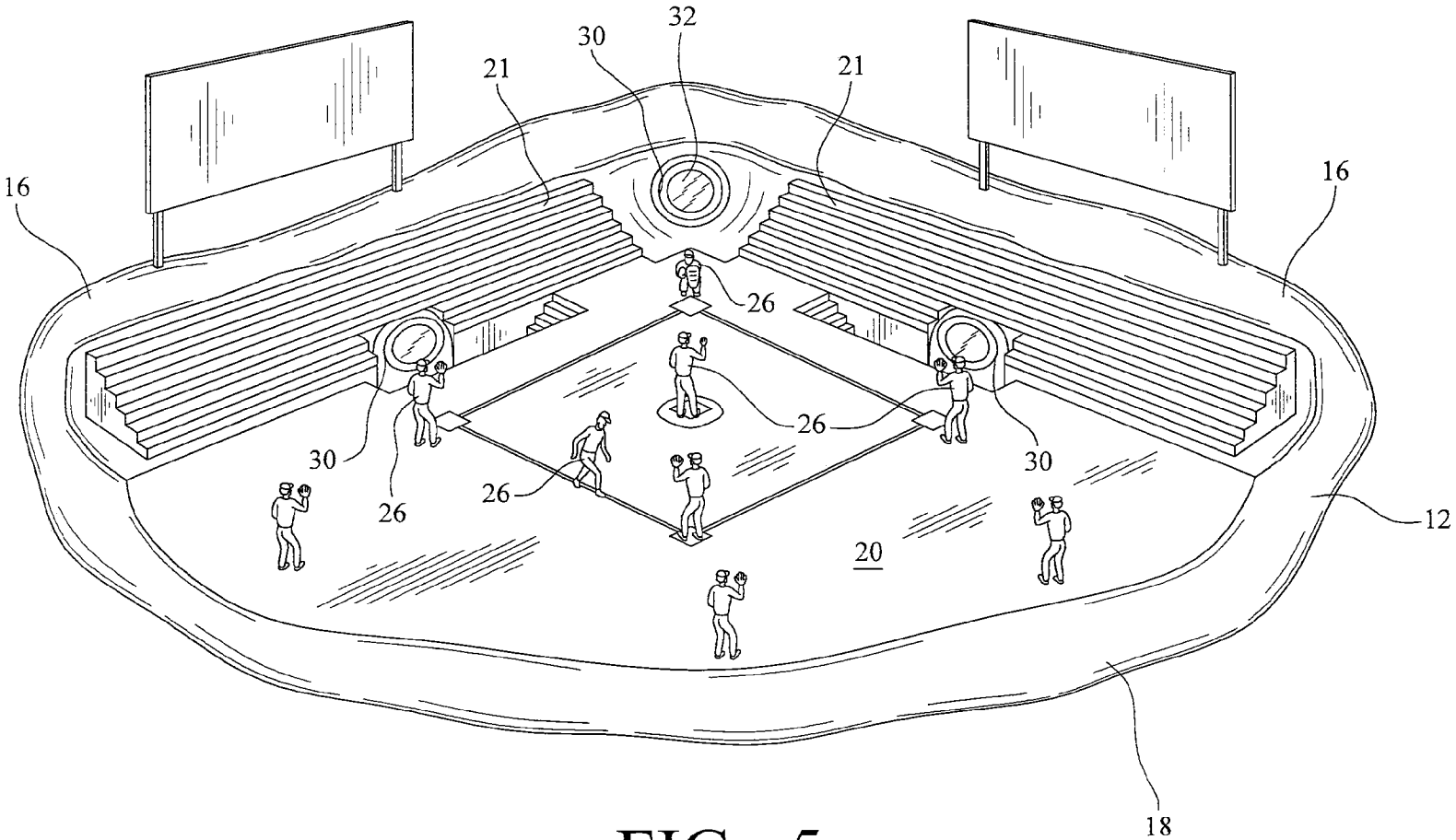
FIG. 5 is a view from the front end of the base illustrating another embodiment of the invention where the scene is a baseball park.

More elaborate scenes are within the scope of the invention. For example, FIG. 5, where like reference numbers denote like parts and functions, illustrates the base 12 having an upper surface 20 that simulates a baseball field. The end and side faces, 16 and 18, of the base 12 are extended above the upper surface 20 and their inward facing surfaces represent seating for fans in the manner of a baseball stadium. As illustrated, ten FIG. 26 may be on the field to represent the nine positions taken by the defensive team and the batter who is shown running towards second base. One or more of the FIG. 26 are movable in the same manner as for the surfing FIG. 26 discussed above. As illustrated, at least one face of the base 12, the end face 16 nearest home plate is provided with an opening 30 in which is received the optical viewing device 32 of the type described above in connection with the surfing scene. Preferably, each defensive player is movable so that the observer can simulate the various positions the players may take in making a defensive play in response to a hit ball.

In another aspect of the invention the optical viewing device 32 is movable to various locations around the base 12 so that the observer can view the scene from various angles. For example, openings 30 are formed in the side faces 16 of the base 12 in which the optical viewing device 32 can be positioned to allow the observer to view the setting from either side of the field as well as from behind home plate.

As most clearly shown in FIG. 4, the movable FIG. 26 comprises an actor form 34 configured to be consistent with the scene. The actor form 34 is secured to a support member 36 that supports the actor form 34 in an upright position on the upper surface 20 of the base 12. A strip 38 of magnetic or magnetically attractable material is secured to the lower surface of the support member 36 and a pair of external magnets 28 are used to move the FIG. 26 by magnetic attraction between the external magnets and the strip 38 of magnetic or magnetically attractable material as already described in connection with the embodiment of the invention shown in FIG. 1. Preferably, as already explained, the magnets 28 are moved by the observer's fingers. Alternatively, the movable FIG. 26, especially in the case of a baseball field or football field scene in which the upper surface 20 of the base 12 is essentially level, can be manually placed without the use of magnets.

Figure 7:
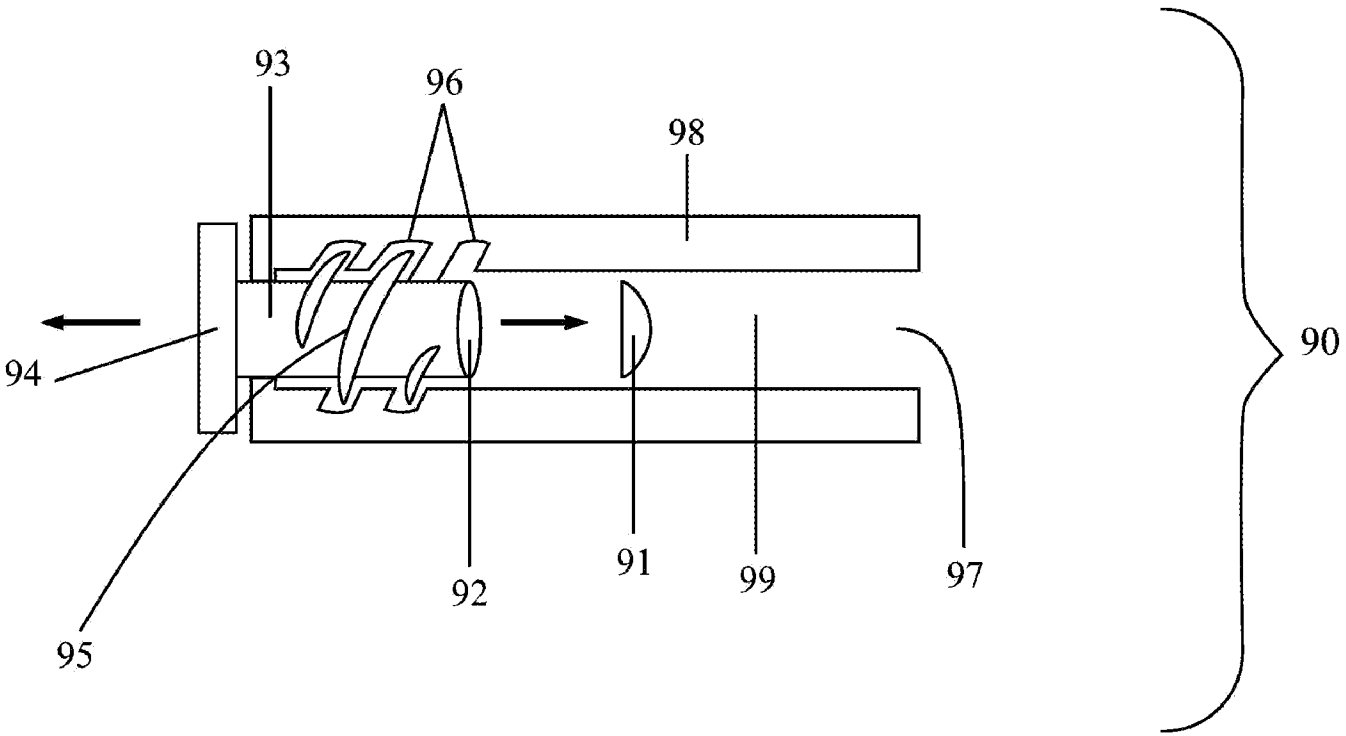
FIG. 7 is a view partially in section and in enlarged scale of the fish-eye lens portion of the sculpture, showing the lens in its magnification mode, in which the lens can be screwed forward and backward along its screw threads to zoom in or zoom out on the surfer.

FIG. 7 is a side view of an embodiment of the fish-eye lens portion of the invention in which the lens component (generally indicated by reference number 90) has a fixed lens (91) and an adjustable lens (92). The adjustable lens (92) is attached to the end of a hollow viewing tube (93) which sits in a lens cavity (99) and is held in place by encasing material (98). The hollow viewing tube (93) has an eyepiece viewer (94) located on the end closest to where a user will view, and screw threads (95) which fit into screw thread cavities (96) built into the encasing material (98). The screw threads (95) turn as the eyepiece viewer (94) is turned, thereby moving the adjustable lens (92) to zoom in or zoom out, as the adjustable lens (92) moves forward and backward, toward the viewer and back toward the distal end (97) of the lens cavity (99).

Figure 8:
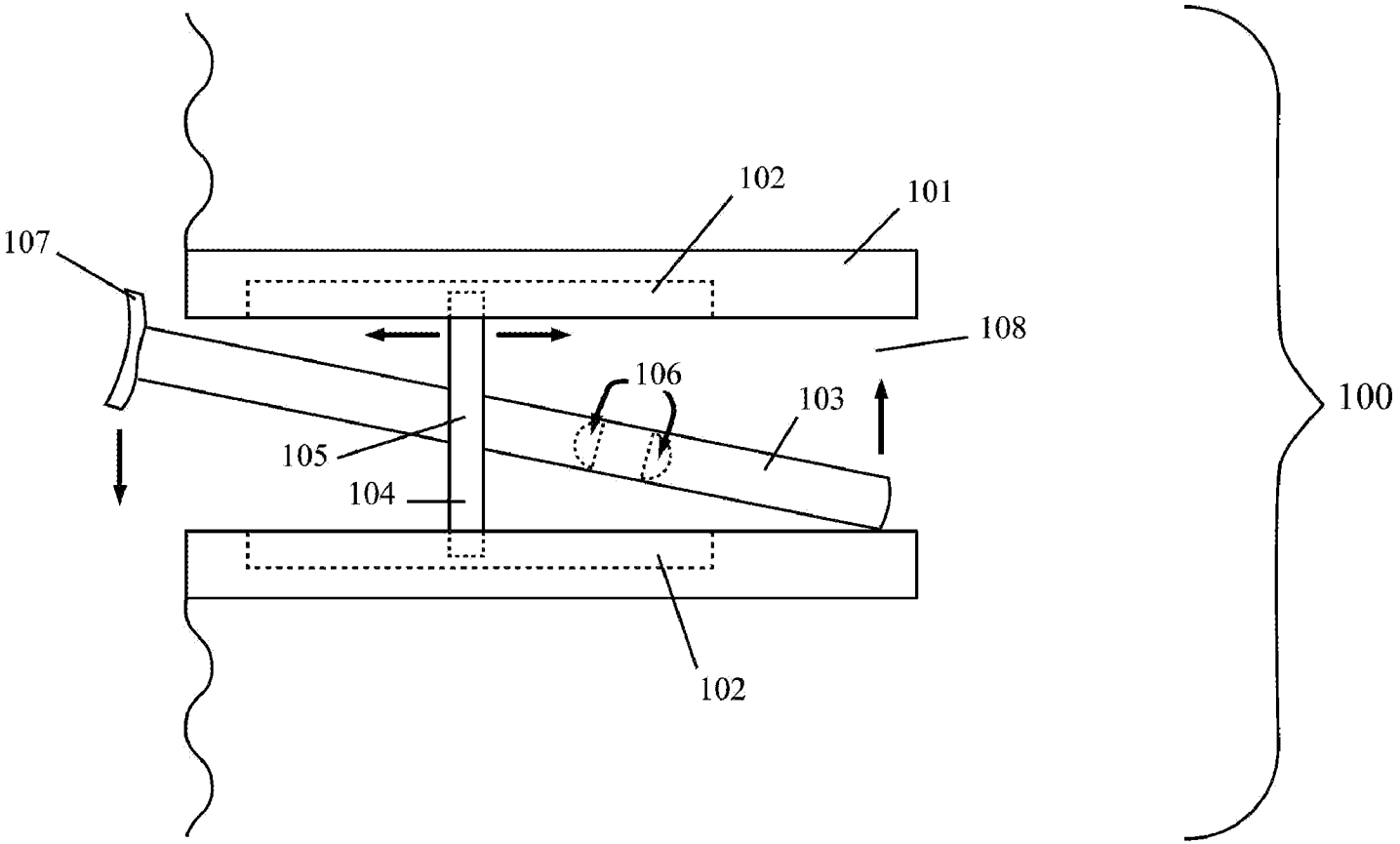
FIG. 8 is a partial, front view of the fish-eye lens portion of the sculpture, showing the lens in its pivot mode, in which the lens can be moved up and down or side to side, to afford a viewer a wide variety of different views of the surfer and the wave.

FIG. 8 is a side view of another embodiment of the fish-eye lens portion of the invention. This embodiment, generally referred to by reference number 100, shows how the hollow viewing tube (103) with its two lenses (106) can move both up and down (vertical arrows show range of movement), as it pivots off a pivot point (105), as well as being slid in either direction (horizontal arrows show direction of movement). The hollow viewing tube (103) is attached to a circular rotating device (104) through a pivot point (105), through which a piece of metal or plastic (not shown in this figure) holds the hollow viewing tube (103) in place. The circular rotating device (104) can be slid in either direction by pushing it or pulling the eyepiece viewer (107), along tracks (102) built into the encasing material (101), and rotated 360 degrees by twisting the eyepiece viewer (107) for leverage. In this embodiment, the user can not only zoom in and zoom out by moving the hollow viewing tube (103) in and out of the lens cavity (108), but also move his/her line of sight in numerous different directions by twisting and moving the hollow viewing tube (103) around the pivot point (105) and rotating the entire circular rotating device (104).

From the foregoing can be seen that the miniature scene of the present invention allows an observer to view the scene as though he were actually present. In addition the movable figures in combination with the viewing device provide an action scene that is highly entertaining for both adults and children. The figures in one embodiment of the invention are moved by magnetic attraction between external magnets which are moved over the exterior surface of the base by the observer's fingers and a strip of magnetic or magnetically attractable material on the supporting member of the figure. In this manner the observer can be viewing the scene while simultaneously moving a figure to a different location in the scene. The base can be provided in a variety of colors appropriate to the scene presented by the base.

As will be understood by those skilled in the art, various arrangements which lie within the spirit and scope of the invention other than those described in detail in the specification will occur to those persons skilled in the art. It is therefore to be understood that the invention is to be limited only by the claims appended hereto.

What is claimed is:

1. A sculpture depicting a scene for an activity that may be carried out at said scene, said device comprising:

a base member, said base member having at least one surface configured to represent a scene comprising a setting for an activity carried out in said setting;

a cylindrical optical viewer mounted in said base, said optical viewer comprising a wide angle lens through which an observer can observe the scene;

at least one figure configured to represent an actor in said activity carried out in said setting, said figure being movably attachable to said base for movement to various locations in said setting by the observer;

a control element configured to be movable along a lower surface of the base by the observer; and wherein:

the observer can view the scene and the figure and achieve the visual effect of being at the scene;

the control element being configured such that movement thereof by the observer to a position on the lower surface of the base causes corresponding movement of the figure to a corresponding position on an upper surface of the base;

the control element has at least one of a magnet and magnetically attractable material disposed therewith;

the figure including at least one of a magnet and magnetically attractable material disposed therewith and being configured to be magnetically attractable to the control element;

the magnetic attraction between the control element and the figure causing the figure to be retained against the upper surface of the base;

the magnetic attraction between the control element and the figure further causing movement of the figure along the upper surface to a corresponding position of the control element along the lower surface.

2. The device of claim 1 wherein an upper surface of said base is configured to represent said scene.

3. The device of claim 1 wherein said optical viewer comprises a cylindrical housing, said cylindrical housing including a viewing lens at one end for viewing through said cylindrical housing and a wide angle lens adjacent the opposite end, at least one of said end walls and side walls is adapted for mounting said optical viewer.

4. The device of claim 1 wherein said upper surface of said base is configured to represent a large curling wave and said figure is configured to represent a surfer on a surfboard.

5. The device of claim 1 wherein said upper surface of said base is configured to represent a portion of a skateboard park and said figure is configured to represent an individual on a skateboard.

6. The device of claim 1 wherein said upper surface of said base is configured to represent an athletic field and said end and sides of said base representing a spectator seating area for said athletic field, said seating area surrounding and extending above said upper surface of said base, figures representing players on said field are movably positioned at various locations on said field.

7. The device of claim 1 wherein said upper surface of said base is configured to represent a stadium and said end and side faces extend above said upper surface to define the seating portion of said stadium, said figures representing opposing players being movably positioned at said upper surface of said base.

8. The device of claim 1 wherein:

the control element includes a pair of magnets configured to facilitate tracking of the orientation of the figure as the figure is moved along the upper surface as a result of movement of the control element along the lower surface.

9. The device of claim 1 wherein:

the control element is adapted to be worn on the observer's finger.

* * * * *